US008893991B2

(12) United States Patent
Alexander et al.

(10) Patent No.: US 8,893,991 B2
(45) **Date of Patent: *Nov. 25, 2014**

(54) HAND-HELD COATING DISPENSER DEVICE

(71) Applicant: Finishing Brands Holdings Inc., Minneapolis, MN (US)

(72) Inventors: Kevin L. Alexander, Brownsburg, IN (US); Gene P. Altenburger, Maumee, OH (US); Michael C. Rodgers, Montpelier, OH (US)

(73) Assignee: Finishing Brands Holdings Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/754,297

(22) Filed: Jan. 30, 2013

(65) Prior Publication Data

US 2013/0140384 A1 Jun. 6, 2013

Related U.S. Application Data

(62) Division of application No. 12/838,966, filed on Jul. 19, 2010, now Pat. No. 8,382,015, which is a division of application No. 11/098,752, filed on Apr. 4, 2005, now Pat. No. 7,757,973.

(51) Int. Cl.

| | |
|---|---|
| ***B05B 5/00*** | (2006.01) |
| ***B05B 5/053*** | (2006.01) |
| ***B05B 5/03*** | (2006.01) |
| ***B05B 7/12*** | (2006.01) |
| *B05B 7/24* | (2006.01) |

(52) U.S. Cl.

CPC ..... *B05B 5/03* (2013.01); *B05B 5/0531* (2013.01); *B05B 7/2491* (2013.01); *B05B 7/12* (2013.01); *B05B 5/0532* (2013.01)

USPC ..... 239/690; 239/692; 239/695; 239/691; 239/600; 239/289; 239/526

(58) Field of Classification Search

CPC ..... B05B 5/0531; B05B 5/0532; B05B 5/03; B05B 7/12; B05B 7/2491

USPC ..... 239/124–127, 526, 600

See application file for complete search history.

(56) References Cited

U.S. PATENT DOCUMENTS 2,244,686 A * 6/1941 Garrison et al. ..... 239/76
3,851,618 A 12/1974 Bentley (Continued)

FOREIGN PATENT DOCUMENTS

| | | |
|---|---|---|
| CN | 1235564 | 11/1999 |
| CN | 2421082 | 2/2001 |
| EP | 1 477 232 | 11/2004 |

OTHER PUBLICATIONS

English language summary of Oct. 24, 2008 of Chinese Patent Application No. 2006800108293.

(Continued)

*Primary Examiner* — Dinh Q Nguyen
(74) *Attorney, Agent, or Firm* — Barnes & Thornburg LLP

(57) ABSTRACT

A hand-held, electrostatically- and/or compressed gas-aided coating material dispensing device comprises a barrel and a handle extending downward from the barrel. The handle includes a module selected from modules having a number of different characteristics for coupling sources of coating material, compressed gas and/or electrical supply to the coating material dispensing device.

8 Claims, 6 Drawing Sheets

(56) References Cited

U.S. PATENT DOCUMENTS

| | | | | |
|---|---|---|---|---|
| 3,875,892 | A | 4/1975 | Gregg et al. | |
| 3,894,272 | A | 7/1975 | Bentley | |
| 3,940,061 | A | 2/1976 | Gimple et al. | |
| 3,964,683 | A | 6/1976 | Gimple | |
| 3,990,609 | A | 11/1976 | Grant | |
| 4,001,935 | A | 1/1977 | Krohn et al. | |
| 4,002,777 | A | 1/1977 | Juvinall et al. | |
| 4,030,857 | A | 6/1977 | Smith, Jr. | |
| 4,037,561 | A | 7/1977 | LaFave et al. | |
| 4,075,677 | A | 2/1978 | Bentley | |
| 4,081,904 | A | 4/1978 | Krohn et al. | |
| 4,105,164 | A | 8/1978 | Lau et al. | |
| 4,106,699 | A * | 8/1978 | Holt | 239/124 |
| 4,114,564 | A | 9/1978 | Probst | |
| 4,116,364 | A | 9/1978 | Culbertson et al. | |
| 4,133,483 | A | 1/1979 | Henderson | |
| D252,097 | S | 6/1979 | Probst et al. | |
| 4,165,022 | A | 8/1979 | Bentley et al. | |
| 4,169,545 | A | 10/1979 | Decker | |
| 4,174,070 | A | 11/1979 | Lau et al. | |
| 4,174,071 | A | 11/1979 | Lau et al. | |
| 4,187,527 | A | 2/1980 | Bentley | |
| 4,214,709 | A | 7/1980 | Scull et al. | |
| 4,219,865 | A | 8/1980 | Malcolm | |
| 4,248,386 | A | 2/1981 | Morle | |
| 4,290,091 | A | 9/1981 | Malcolm | |
| 4,294,411 | A | 10/1981 | Hastings et al. | |
| 4,324,812 | A | 4/1982 | Bentley | |
| 4,331,298 | A | 5/1982 | Bentley et al. | |
| RE30,968 | E | 6/1982 | Grant | |
| 4,361,283 | A | 11/1982 | Hetherington et al. | |
| D270,179 | S | 8/1983 | Grime | |
| D270,180 | S | 8/1983 | Grime | |
| D270,367 | S | 8/1983 | Grime | |
| D270,368 | S | 8/1983 | Grime | |
| 4,401,268 | A | 8/1983 | Pomponi, Jr. | |
| 4,433,812 | A | 2/1984 | Grime | |
| 4,437,614 | A | 3/1984 | Garcowski | |
| 4,453,670 | A | 6/1984 | Sirovy | |
| 4,481,557 | A | 11/1984 | Woodruff | |
| 4,483,483 | A | 11/1984 | Grime | |
| 4,485,427 | A | 11/1984 | Woodruff et al. | |
| 4,513,913 | A | 4/1985 | Smith | |
| 4,529,131 | A | 7/1985 | Rutz | |
| 4,537,357 | A | 8/1985 | Culbertson et al. | |
| 4,598,871 | A | 7/1986 | Hartle | |
| 4,606,501 | A | 8/1986 | Bate et al. | |
| 4,613,082 | A | 9/1986 | Gimple et al. | |
| D287,266 | S | 12/1986 | Knetl et al. | |
| 4,702,420 | A | 10/1987 | Rath | |
| 4,745,520 | A | 5/1988 | Hughey | |
| 4,747,546 | A | 5/1988 | Talacko | |
| 4,759,502 | A | 7/1988 | Pomponi, Jr. et al. | |
| 4,760,962 | A | 8/1988 | Wheeler | |
| 4,770,117 | A | 9/1988 | Hetherington et al. | |
| 4,824,026 | A | 4/1989 | Tamura et al. | |
| 4,844,342 | A | 7/1989 | Foley | |
| D303,139 | S | 8/1989 | Morgan | |
| D305,057 | S | 12/1989 | Morgan | |
| D305,452 | S | 1/1990 | Morgan | |
| D305,453 | S | 1/1990 | Morgan | |
| 4,911,367 | A | 3/1990 | Lasley | |
| 4,927,079 | A | 5/1990 | Smith | |
| 4,934,603 | A | 6/1990 | Lasley | |
| 4,934,607 | A | 6/1990 | Lasley | |
| 4,971,257 | A | 11/1990 | Birge | |
| 4,993,645 | A | 2/1991 | Buschor | |
| 5,022,590 | A | 6/1991 | Buschor | |
| D318,712 | S | 7/1991 | Buschor | |
| 5,054,687 | A | 10/1991 | Burns et al. | |
| 5,056,720 | A | 10/1991 | Crum et al. | |
| 5,064,119 | A | 11/1991 | Mellette | |
| 5,074,466 | A | 12/1991 | Santiago | |
| 5,090,623 | A | 2/1992 | Burns et al. | |
| D325,241 | S | 4/1992 | Buschor | |
| 5,118,080 | A | 6/1992 | Hartmann | |
| 5,119,992 | A | 6/1992 | Grime | |
| 5,121,884 | A | 6/1992 | Noakes | |
| 5,159,544 | A | 10/1992 | Hughey et al. | |
| 5,178,330 | A | 1/1993 | Rodgers | |
| 5,180,104 | A | 1/1993 | Mellette | |
| 5,209,365 | A | 5/1993 | Wood | |
| 5,209,405 | A | 5/1993 | Robinson et al. | |
| 5,236,129 | A | 8/1993 | Grime et al. | |
| 5,284,299 | A | 2/1994 | Medlock | |
| 5,284,301 | A | 2/1994 | Kieffer | |
| 5,289,974 | A | 3/1994 | Grime et al. | |
| 5,299,740 | A | 4/1994 | Bert | |
| 5,303,865 | A | 4/1994 | Bert | |
| 5,330,108 | A | 7/1994 | Grime et al. | |
| 5,332,156 | A | 7/1994 | Wheeler | |
| 5,332,159 | A | 7/1994 | Grime et al. | |
| D349,559 | S | 8/1994 | Vanderhoef et al. | |
| 5,351,887 | A | 10/1994 | Heterington et al. | |
| 5,395,054 | A | 3/1995 | Wheeler | |
| 5,400,971 | A | 3/1995 | Maugans et al. | |
| 5,553,788 | A | 9/1996 | Del Gaona et al. | |
| 5,582,350 | A | 12/1996 | Kosmyna et al. | |
| 5,618,001 | A | 4/1997 | Del Gaone et al. | |
| 5,639,027 | A | 6/1997 | Fritz | |
| RE35,769 | E | 4/1998 | Grime et al. | |
| 5,803,313 | A | 9/1998 | Flatt et al. | |
| 5,829,679 | A | 11/1998 | Strong | |
| 5,836,517 | A | 11/1998 | Burns et al. | |
| RE36,378 | E | 11/1999 | Mellette | |
| 5,978,244 | A | 11/1999 | Hughey | |
| 6,144,570 | A | 11/2000 | Hughey | |
| 6,179,223 | B1 | 1/2001 | Sherman et al. | |
| 6,189,809 | B1 | 2/2001 | Schwebemeyer | |
| 6,276,616 | B1 | 8/2001 | Jenkins | |
| 6,402,058 | B2 | 6/2002 | Kaneko et al. | |
| 6,423,142 | B1 | 7/2002 | Hughey | |
| 6,460,787 | B1 | 10/2002 | Hartle et al. | |
| 6,562,137 | B2 | 5/2003 | Hughey | |
| 6,572,029 | B1 | 6/2003 | Holt | |
| 6,622,937 | B2 | 9/2003 | Schroeder et al. | |
| 6,669,112 | B2 | 12/2003 | Reetz, III et al. | |
| 6,698,670 | B1 | 3/2004 | Gosis et al. | |
| 6,712,292 | B1 | 3/2004 | Gosis et al. | |
| 6,874,702 | B2 | 4/2005 | Turnbull | |
| 7,757,973 | B2 * | 7/2010 | Alexander et al. | 239/690 |
| 8,016,213 | B2 * | 9/2011 | Altenburger | 239/526 |
| 8,382,015 | B2 * | 2/2013 | Alexander et al. | 239/690 |
| 2002/0038824 | A1 | 4/2002 | Ulrich | |
| 2003/0006322 | A1 | 1/2003 | Hartle et al. | |
| 2004/0256493 | A1 | 12/2004 | Turnbull | |

OTHER PUBLICATIONS

Official action from Australian Patent Application No. 2006231484 dated Aug. 18, 2009.

* cited by examiner

HAND-HELD COATING DISPENSER DEVICE

CROSS REFERENCE TO RELATED APPLICATIONS

This application is a divisional of U.S. Ser. No. 12/838,966 filed Jul. 19, 2010, now U.S. Pat. No. 8,382,015. U.S. Ser. No. 12/838,966 is a divisional of U.S. Ser. No. 11/098,752 filed Apr. 4, 2005, now U.S. Pat. No. 7,757,973. The disclosures of both U.S. Ser. No. 12/838,966 and U.S. Ser. No. 11/098,752 are hereby incorporated herein by reference.

FIELD OF THE INVENTION

This invention relates to hand-held coating atomizing and dispensing equipment (hereinafter sometimes spray guns). However, it is believed to be useful in other applications as well.

BACKGROUND OF THE INVENTION

A great number of spray guns are known. Among configurations of interest are the configurations illustrated and described in the following listed U.S. Patents and published applications: 2003/0006322; U.S. Pat. Nos. 6,712,292; 6,698,670; 6,669,112; 6,572,029; 6,460,787; 6,402,058; RE36,378; U.S. Pat. Nos. 6,276,616; 6,189,809; 6,179,223; 5,836,517; 5,829,679; 5,803,313; RE35,769; U.S. Pat. Nos. 5,639,027; 5,618,001; 5,582,350; 5,553,788; 5,400,971; 5,395,054; D349,559; U.S. Pat. Nos. 5,351,887; 5,332,159; 5,332,156; 5,330,108; 5,303,865; 5,299,740; 5,289,974; 5,284,301; 5,284,299; 5,236,129; 5,209,405; 5,209,365; 5,178,330; 5,119,992; 5,118,080; 5,180,104; D325,241; U.S. Pat. Nos. 5,090,623; 5,074,466; 5,064,119; 5,054,687; D318,712; U.S. Pat. Nos. 5,022,590; 4,993,645; 4,934,607; 4,934,603; 4,927,079; 4,911,367; D305,453; D305,452; D305,057; D303,139; U.S. Pat. Nos. 4,844,342; 4,770,117; 4,760,962; 4,759,502; 4,747,546; 4,702,420; 4,613,082; 4,606,501; D287,266; U.S. Pat. Nos. 4,537,357; 4,529,131; 4,513,913; 4,483,483; 4,453,670; 4,437,614; 4,433,812; 4,401,268; 4,361,283; D270,368; D270,367; D270,180; D270,179; RE30,968; U.S. Pat. Nos. 4,331,298; 4,248,386; 4,214,709; 4,174,071; 4,174,070; 4,169,545; 4,165,022; D252,097; U.S. Pat. Nos. 4,133,483; 4,116,364; 4,114,564; 4,105,164; 4,081,904; 4,037,561; 4,030,857; 4,002,777; 4,001,935; 3,990,609; 3,964,683; and, 3,940,061. Reference is here also made to U.S. Pat. Nos. 6,562,137; 6,423,142; 6,144,570; 5,978,244; 5,159,544; 4,745,520; 4,485,427; 4,481,557; 4,324,812; 4,187,527; 4,075,677; 3,894,272; 3,875,892; and, 3,851,618. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to a first aspect of the invention, a hand-held, electrostatically-aided coating material dispensing device comprises a barrel and a handle extending generally downward from the barrel. The handle includes a module selected from a group of modules including at least two of: a module including a compressed gas-driven dynamoelectric machine, a compressed gas input port and an electrical output port; a module including an input port for coupling to a low-magnitude potential source and an electrical output port; a module including a battery and an electrical output port; and, a module including a port for coupling to a high-magnitude potential.

Illustratively according to this aspect of the invention, the group of modules further includes a module including a fuel cell and an electrical output port.

Further illustratively according to this aspect of the invention, the coating material dispensing device includes an inverter and multiplier.

Illustratively according to this aspect of the invention, the compressed gas-driven dynamoelectric machine comprises an air turbine coupled to the compressed gas input port.

Illustratively according to this aspect of the invention, the module is selected from a group of modules including: a module including a port for coupling to a low-magnitude potential source and an electrical output port; and, a module including a port for coupling to a high-magnitude potential source. The selected module further includes a port for the supply of coating material to the coating material dispensing device. A line drawn through the port for coupling an electrical potential source to the coating material dispensing device and the port for the supply of coating material to the coating material dispensing device extends generally in the same direction as a longitudinal extent of the barrel.

Alternatively illustratively according to this aspect of the invention, the line extends in a direction other than a direction of a longitudinal extent of the barrel.

Illustratively according to this aspect of the invention, the module comprises a module including a compressed gas-driven dynamoelectric machine, a compressed gas input port and an electrical output port. The module further includes a port for the supply of coating material to the coating material dispensing device. A line drawn through the compressed gas input port and the port for the supply of coating material to the coating material dispensing device extends generally in the same direction as a longitudinal extent of the barrel.

Alternatively illustratively according to this aspect of the invention, the line extends in a direction other than a direction of a longitudinal extent of the barrel.

According to another aspect of the invention, a hand-held coating material dispensing device comprises a barrel and a handle extending generally downward from the barrel. The handle includes a module including first and second ports for coupling to first and second conduits, respectively. A first one of said conduits provides a flow of the coating material to be dispensed to the coating material dispensing device. A second one of said conduits provides a flow of the coating material to be dispensed away from the coating material dispensing device.

Illustratively according to this aspect of the invention, the coating material dispensing device comprises a compressed gas-aided coating material dispensing device. The module includes a port for coupling to a compressed gas source and the first and second ports. The module is selected from: a module in which a line drawn through the first port and the port for coupling to a compressed gas source extends in a direction other than a direction of a longitudinal extent of the barrel; and, a module in which a line drawn through the first port and the port for coupling to a compressed gas source extends generally in the same direction as a longitudinal extent of the barrel.

Illustratively according to this aspect of the invention, the coating material dispensing device comprises a compressed gas-aided coating material dispensing device. The module includes a port for coupling to a compressed gas source and the first and second ports. The module is selected from: a module in which a line drawn through the second port and the port for coupling to a compressed gas source extends in a direction other than a direction of a longitudinal extent of the barrel; and, a module in which a line drawn through the second port and the port for coupling to a compressed gas source extends generally in the same direction as a longitudinal extent of the barrel.

Illustratively according to this aspect of the invention, the coating material dispensing device comprises an electrostatically-aided coating material dispensing device. The module includes a port for coupling an electrical potential source to the coating material dispensing device. The module is selected from: a module in which a line drawn through the first port and the port for coupling to an electrical potential source extends in a direction other than a direction of a longitudinal extent of the barrel; and, a module in which a line drawn through the first port and the port for coupling to an electrical potential source extends generally in the same direction as a longitudinal extent of the barrel.

Illustratively according to this aspect of the invention, the coating material dispensing device comprises an electrostatically-aided coating material dispensing device. The module includes a port for coupling an electrical potential source to the coating material dispensing device. The module is selected from: a module in which a line drawn through the second port and the port for coupling to an electrical potential source extends in a direction other than a direction of a longitudinal extent of the barrel; and, a module in which a line drawn through the second port and the port for coupling to an electrical potential source extends generally in the same direction as a longitudinal extent of the barrel.

According to another aspect of the invention, a hand-held, compressed gas-aided coating material dispensing device comprises a barrel and a handle extending generally downward from the barrel. The handle includes a module selected from a group of modules including at least one of: a module for regulating the pressure of the compressed gas provided to the coating material dispensing device; a module for regulating the flow rate of coating material provided to the coating material dispensing device; and, a module for regulating the pressure of the compressed gas provided to the coating material dispensing device and the flow rate of the coating material provided to the coating material dispensing device.

According to another aspect of the invention, a hand-held, electrostatically- and compressed gas-aided coating material dispensing device comprises a barrel and a handle extending downward from the barrel. The handle includes a module including ports for coupling to sources of coating material, compressed gas and electrical supply. The module is selected from: a module in which lines drawn through respective pairs of the coating material port, compressed gas port and electrical supply port extends generally in the same direction as the longitudinal extent of the barrel; and a module in which lines drawn through respective pairs of the coating material port, compressed gas port and electrical supply port form sides of a triangle.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Some electrostatically-aided coating atomizing and dispensing equipment (hereinafter sometimes electrostatic spray guns) are powered from dynamoelectric machines, such as internal air turbines that generate electricity from the air being supplied to such spray guns. Spray guns of this general type are illustrated and described in, for example, the above-identified U.S. Pat. Nos. 4,219,865 and 4,290,091. Such spray guns are intended to offer easier installation and to be easier to manipulate. Manufacturers of such spray guns point to the absence of any electrical cables for connecting such spray guns to (an) external power supply(ies).

Some electrostatic spray guns are powered from (an) external power supply(ies). Such external power supplies are typically powered from, for example, 110 VAC, 60 Hz line voltage or 220 VAC, 50 or 60 Hz line voltage, or the like, and are relatively stationary. Such electrostatic spray guns therefore are coupled by high- or low-magnitude potential cables to the external power supply(ies). Although such systems typically are somewhat more involved to install, they typically offer enhanced control, display and user interface functions.

Figure 1:
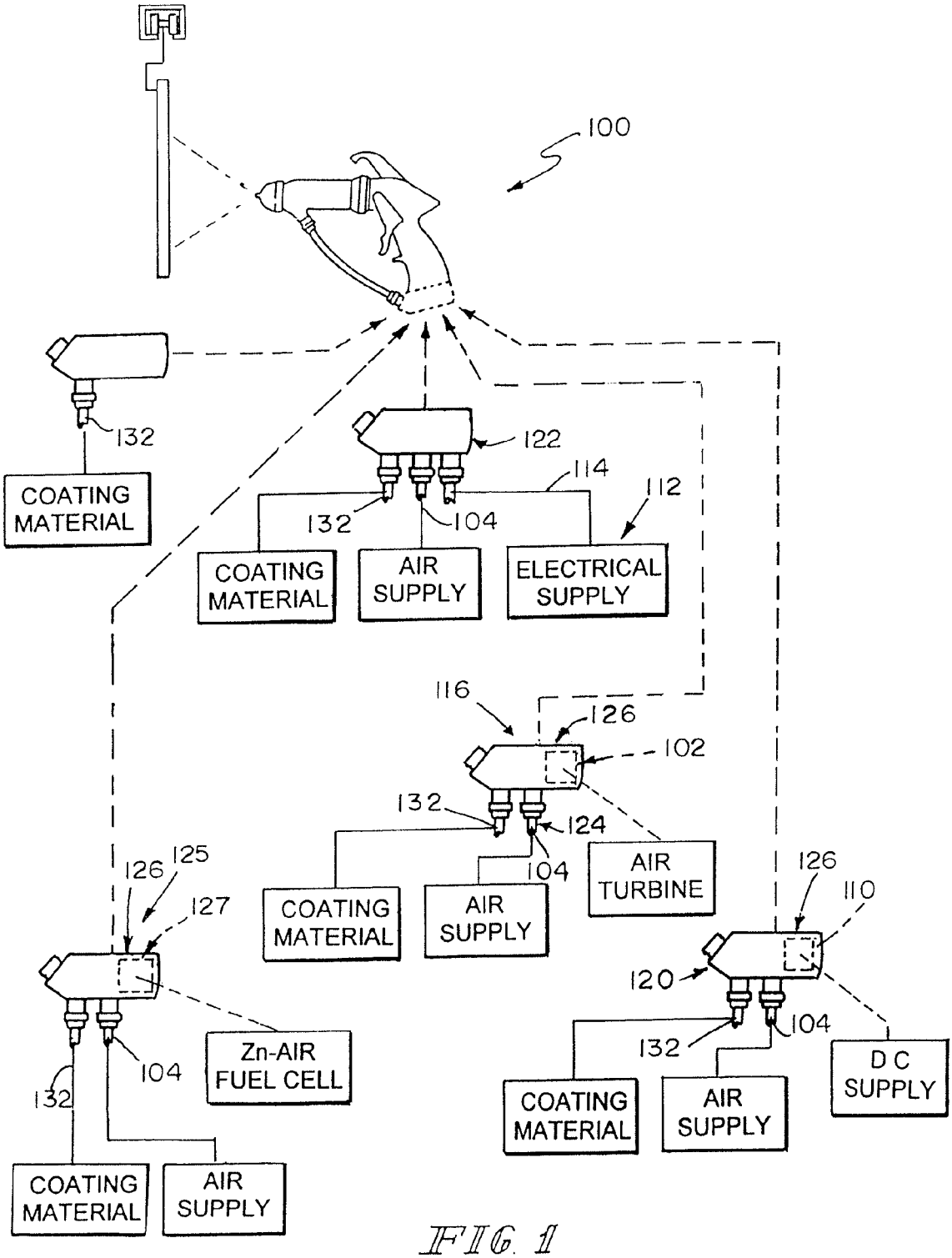
FIG. 1 illustrates simplified diagrams of devices constructed according to the invention.
Figure 2:
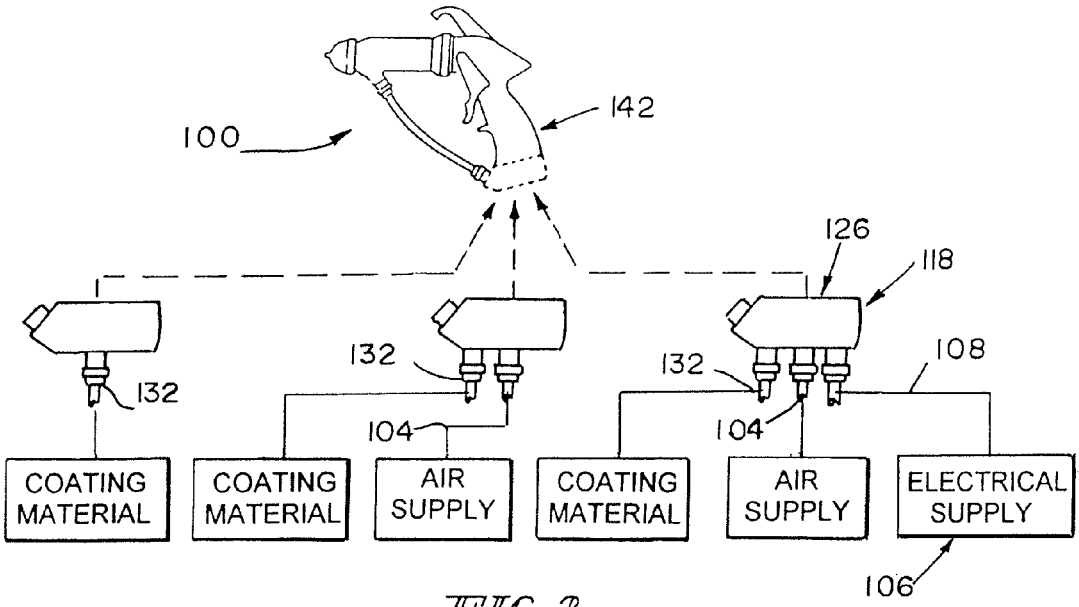
FIG. 2 illustrates simplified diagrams of devices constructed according to the invention.
Figure 4:
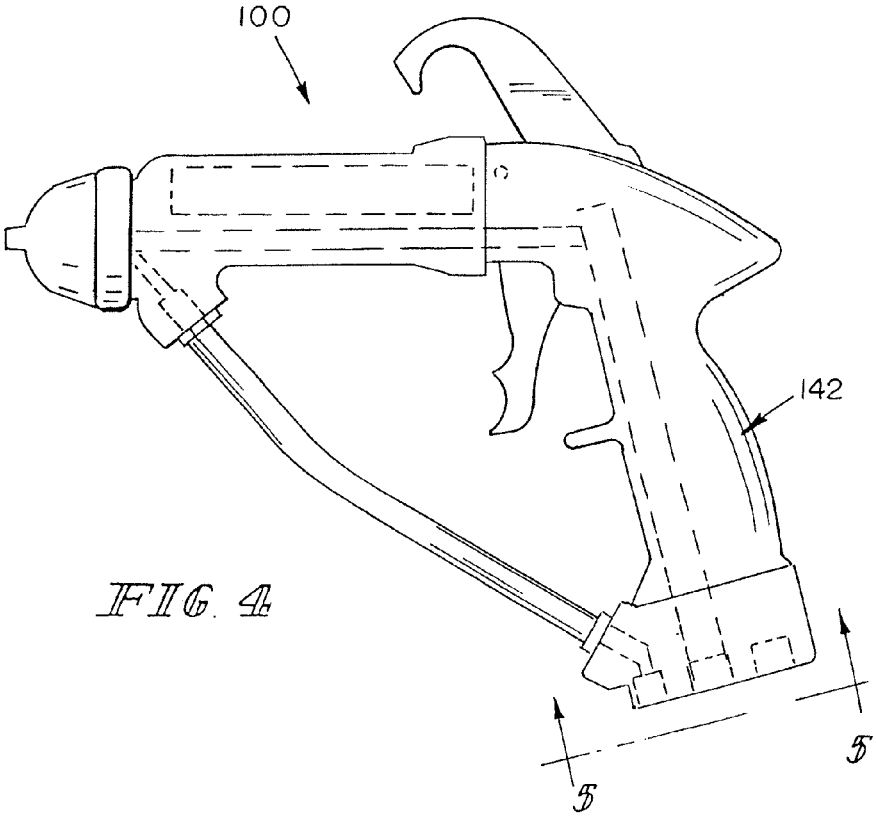
FIG. 4 illustrates a somewhat enlarged side elevational view of a component illustrated in FIGS. 1-2.

Referring now to FIGS. 1 and 2, with a spray gun 100 constructed according to the invention, a user may choose the power source (s)he prefers at the point of sale or may switch between types anytime. This permits users to configure systems to meet input power requirements, either to be powered by an air-driven source 102, FIG. 1, by compressed air delivered to the spray gun through a flexible conduit 104, via either a low-magnitude voltage (for example, +/−24 VDC) supply 106 and low voltage cable 108, FIG. 2, to an on-board inverter and multiplier, a battery pack 110, FIG. 1, containing one or more batteries, for example, batteries of the type which power cordless electric hand tools and the like, which delivers low-magnitude DC voltage to an on-board inverter and multiplier, or a high-magnitude voltage (for example, −35 KVDC, −65 KVDC, or −85 KVDC) supply 112 and high-magnitude voltage cable 114, FIG. 1. Supplies of these various types are illustrated in, for example, above-identified U.S. Pat. Nos. 6,562,137; 6,423,142; 6,144,570; 5,978,244; 5,159,544; 4,745,520; 4,485,427; 4,481,557; 4,324,812; 4,290,091; 4,219,865; 4,187,527; 4,075,677; 3,894,272; 3,875,892; and, 3,851,618.

Figure 3:
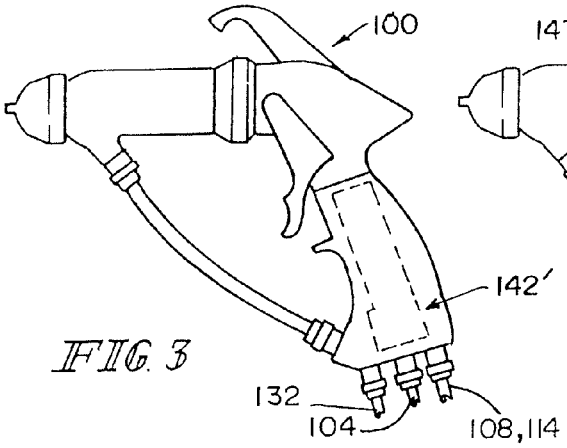
FIG. 3 illustrates a simplified diagram of another device constructed according to the invention.
Figure 9:
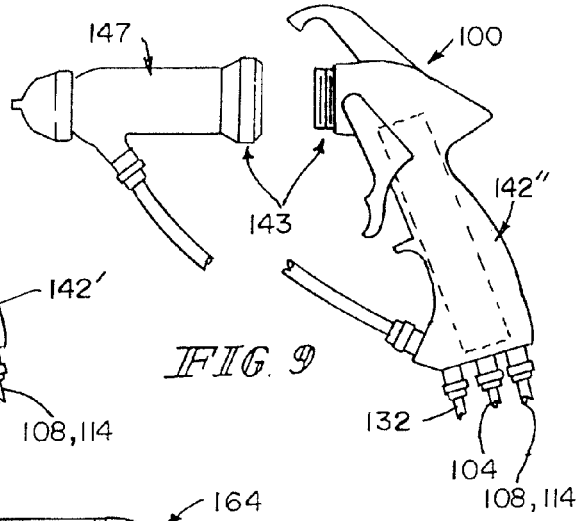
FIG. 9 illustrates a simplified diagram of another device constructed according to the invention.
Figure 6:
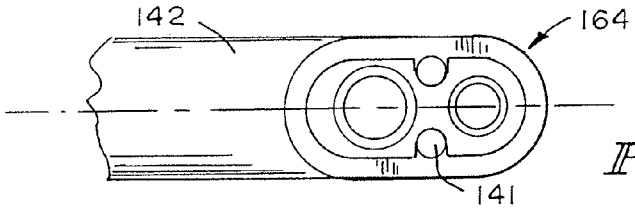
FIGS. 6, 7, 7*a* and 8 illustrate alternative details to the detail illustrated in FIG. 5.
Figure 5:
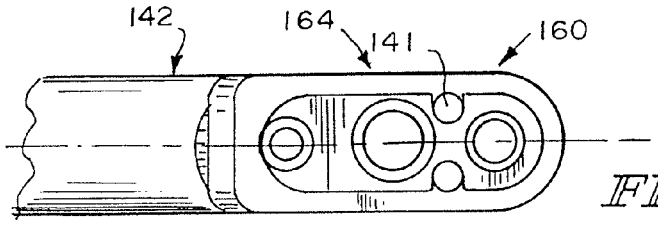
FIG. 5 illustrates a bottom plan view of a detail of the component illustrated in FIG. 4, taken generally along section lines 5-5 thereof.

Power source modules 116, 118, 120, 122, 125 are interchangeable by removing a first module 116, 118, 120, 122, 125 and attaching a second module 116, 118, 120, 122, 125 to the spray gun 100. Module 116, FIG. 1, includes an air turbine 102 with appropriate air input 124 and electrical output 126 connections. Another module 118, FIG. 2, includes a low-magnitude voltage cable 108 assembly with the same electrical output connection 126 as the turbine module 116. Another module 120, FIG. 1, includes battery pack 110 with the same electrical output connection 126 as modules 116, 118. Another module 122, FIG. 1, includes connections for high-magnitude voltage cable 114. Another module 125, FIG. 1, includes a fuel cell 127, such as, for example, a hydrogen/oxygen or zinc/oxygen (air) fuel cell, having, for example, the same electrical output connections 126 as modules 116, 118 and 120, and so on. The modules 116, 118, 120, 122, 125 may be configured for insertion into the handle 142', FIG. 3, for attachment, for example, by (a) threaded fastener(s) 141, to, for example, the lower end of the handle 142, FIGS. 1, 2 and 4-8, or may be configured to provide the entire handle 142", FIG. 9, which may be attached to the barrel 147, for example, by threaded fastener(s) 143 or the like.

Some users prefer one or another of (a) spray gun(s) powered by air-driven sources 102 by compressed air delivered to the spray gun through a flexible conduit 104, low-magnitude supplies 106 and low voltage cables 108 to on-board inverters and multipliers, battery packs 110 which deliver low-magnitude DC voltage to an on-board inverter and multiplier, or high-magnitude supplies 112 and high-magnitude voltage cables 114. Because of the cost of developing, manufacturing and stocking multiple different lines of electrostatic spray guns and related products to offer the customer a choice of power sources, some manufacturers have chosen to focus on (a) specific power source(s) or type(s) of power source(s) and a single electrostatic spray gun line. Modularity of the type described is believed to offer some relief from high development and stocking costs.

Turning to another requirement of some types of spray applications, many types of coating materials which are to be dispensed through spray guns 100 are required to be circulated relatively constantly until they are dispensed. This may be required, for example, to prevent solid components of the coating materials from settling out of the liquid components of the coating materials during periods when the coating materials are not being dispensed. If such coating materials were not continuously circulated when they weren't being dispensed, the coating materials would otherwise sit in the conduits 132, 134 which couple the sources 136 of such coating materials to the spray guns 100.

Figure 7:
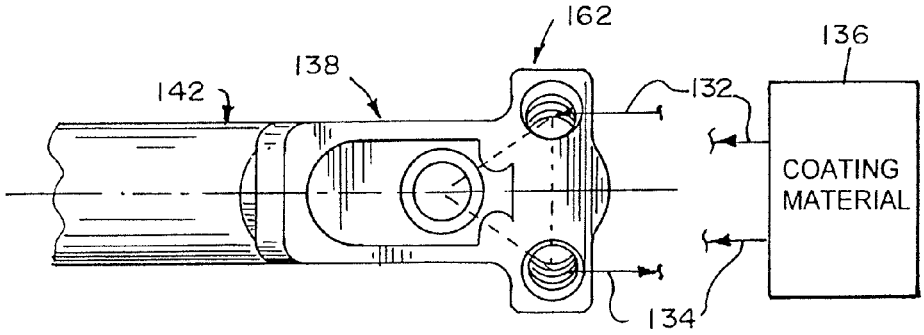
Figure 8:
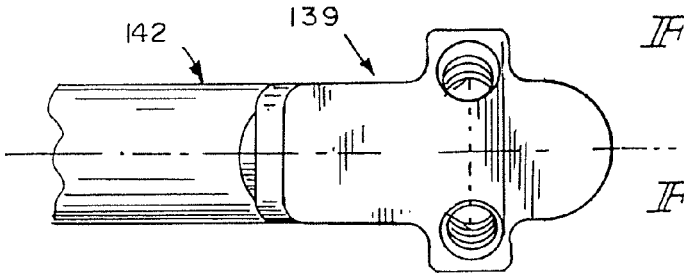
Figure 7A:
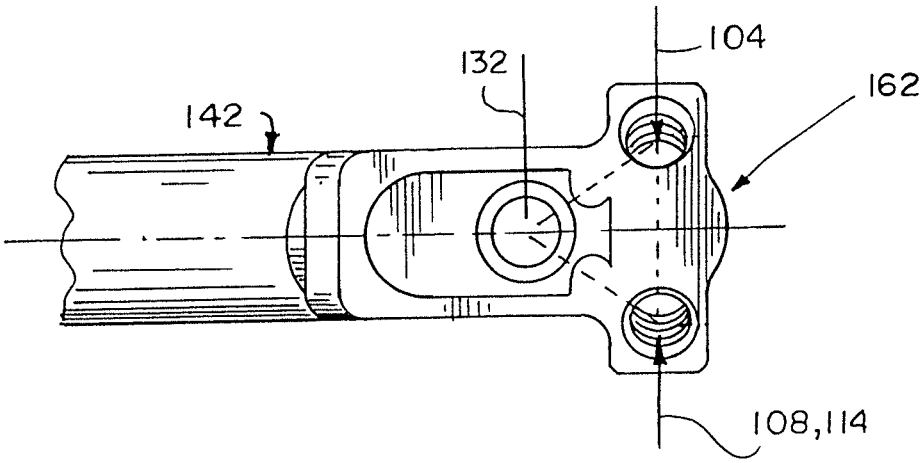

In many prior art spray guns which are used in recirculating type applications, such recirculation is achieved by bringing the conduits for the coating materials requiring recirculation to a fitting on the handle of the spray gun, and returning the coating materials through a separate conduit attached to another fitting on the handle of the spray gun to the coating material source. Attaching multiple fittings to the handle end of the spray gun may result in a heavier, bulkier spray gun that is more difficult to manipulate. Referring to FIGS. 7 and 8, modules 138, 139 according to the invention permits recirculation of the sprayed material to and from the handle 142 of the spray gun 100 through conduits 132, 134 in a lighter, more compact, more ergonomic arrangement.

Figure 10A:
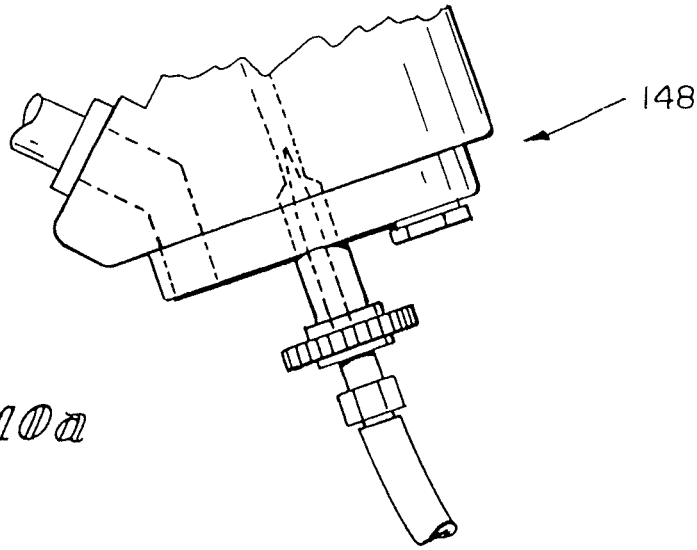
FIGS. 10*a-c* illustrate enlarged fragmentary sectional side elevational views of other devices constructed according to the invention; and, FIG. 11 illustrates an enlarged fragmentary sectional side elevational view of another device.
Figure 10B:
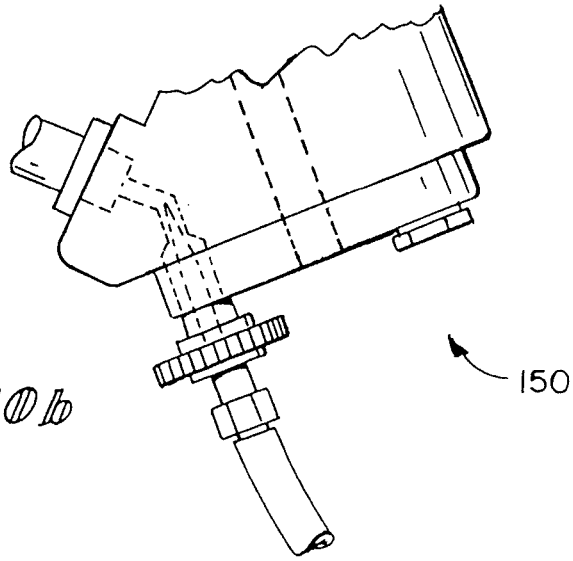
Figure 10C:
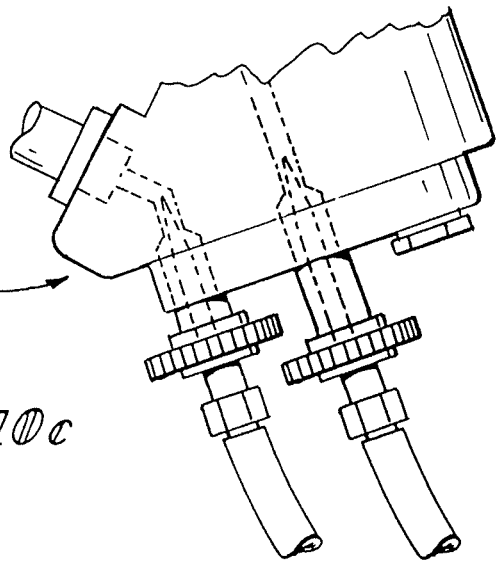

Referring now particularly to FIGS. 10*a-c*, in some coating applications it is desirable to regulate the air and/or coating material being supplied to the spray gun 100 so that (a) constant flow is achieved. In many prior art spray guns, this end is achieved by providing (an) air and/or coating material regulator(s) and associated fittings in the fluid circuitry coupled to the spray gun 100. Such components can be bulky, making manipulation of the spray gun 100 more difficult, or the components can be arranged remote from the spray gun 100, making access to them less convenient. Modules 148, 150, 152 constructed according to the invention permit regulation of air pressure (148, FIG. 10*a*), coating material flow rate (150, FIG. 10*b*), or both (152, FIG. 10*c*) directly on the handle 142, in a lighter and more compact arrangement, thereby resulting in a more ergonomic spray gun 100 with more conveniently accessible regulator controls.

Referring now particularly to FIGS. 5-7 and 7*a*, some users may prefer the in-line arrangement 160 of air conduit 104 (where present), coating material conduit(s) 132, 134 (where present) and electrical cable 108, 114 (where present) connections to the handle 142 of the spray gun 100. Other users may prefer, for example, a triangular arrangement 162 of these connections. In many prior art systems, offering both options requires the manufacturer to design different molds and brackets for the two different configurations. Because of their relatively complicated detail, handle molds are typically relatively expensive and have long lead times. In addition, a user would have only one or the other of the configurations 160, 162 on a particular spray gun. The present invention contemplates that both modules 164, 138, respectively, for the in-line 160 and triangular 162 connections could be maintained, and switched back and forth on a particular spray gun 100.

Figure 11:
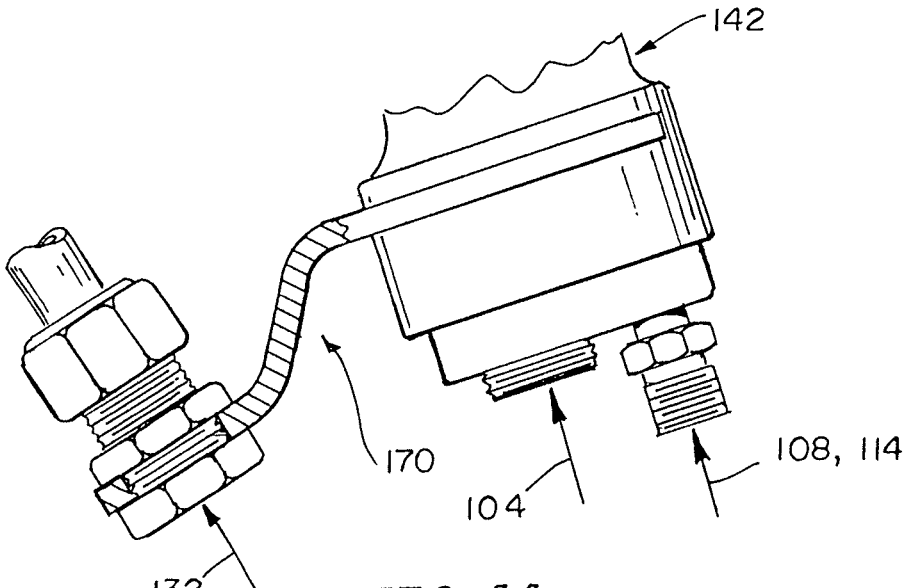

Referring now particularly to FIG. 11, finally, if no module 116, 118, 120, 122, 125, 138, 139, 148, 150, 152, 164 is desired, spray gun 100 can be fitted with a bracket 170 for reduced overall spray gun 100 weight and size. The coating material supply conduit 132, compressed air supply conduit 104, and electrical conductor 108 or 114 are routed directly to the handle 142.

What is claimed is:

1. A hand-held coating material dispensing device comprising a barrel and a handle extending generally away from the barrel to a distal end remote from a junction of the barrel and the handle, the handle including a module including first and second ports for coupling to first and second conduits, respectively, said first conduit for providing a flow of coating material to the coating material dispensing device and said second conduit for providing a flow of coating material away from the coating material dispensing device, wherein the module is selected from a group of modules including at least two of: a module including a compressed gas-driven dynamoelectric machine, a compressed gas input port and an electrical output port; a module including an input port for coupling to a low-magnitude potential source and an electrical output port; a module including a battery and an electrical output port; and, a module including a port for coupling to a high-magnitude potential source.

2. The coating material dispensing device of claim 1 wherein the group of modules further includes a module including a fuel cell and an electrical output port.

3. The coating material dispensing device of claim 1 further including an inverter and multiplier.

4. The coating material dispensing device of claim 1 wherein the compressed gas-driven dynamoelectric machine comprises an air turbine coupled to the compressed gas input port.

5. The coating material dispensing device of claim 1 wherein a line drawn through the port for coupling an electrical potential source to the coating material dispensing device and the first port extends generally in the same direction as a longitudinal extent of the barrel.

6. The coating material dispensing device of claim 1 wherein a line drawn through the port for coupling an electrical potential source to the coating material dispensing device and the first port extends in a direction other than a direction of a longitudinal extent of the barrel.

7. The coating material dispensing device of claim 1 wherein a line drawn through the compressed gas input port of the module including a compressed gas-driven dynamoelectric machine, a compressed gas input port and an electrical output port and the first port extends generally in the same direction as a longitudinal extent of the barrel.

8. The coating material dispensing device of claim 1 wherein a line drawn through the compressed gas input port of the module including a compressed gas-driven dynamoelectric machine, a compressed gas input port and an electrical output port and the first port extends in a direction other than a direction of a longitudinal extent of the barrel.

* * * * *